US012402737B2

(12) United States Patent
McNulty

(10) Patent No.: US 12,402,737 B2
(45) Date of Patent: Sep. 2, 2025

(54) DRINKING CONTAINER

(71) Applicant: Linda McNulty, Fairlawn, OH (US)

(72) Inventor: Linda McNulty, Fairlawn, OH (US)

( * ) Notice: Subject to any disclaimer, the term of this patent is extended or adjusted under 35 U.S.C. 154(b) by 0 days.

(21) Appl. No.: 17/411,690

(22) Filed: Aug. 25, 2021

(65) Prior Publication Data

US 2022/0386795 A1 Dec. 8, 2022

Related U.S. Application Data

(60) Provisional application No. 63/069,920, filed on Aug. 25, 2020.

(51) Int. Cl.
*A47G 19/22* (2006.01)

(52) U.S. Cl.
CPC ..... *A47G 19/2211* (2013.01); *A47G 2400/02* (2013.01)

(58) Field of Classification Search
CPC ..... A47G 19/2211; A47G 19/2205; A47G 19/2266; A47G 19/2272; B65D 1/265; B65D 25/2897; B65D 1/0276
USPC ..... 220/505, 703, 719, 669, 704, 713, 717, 220/23.9; 222/189.07, 572
See application file for complete search history.

(56) References Cited

U.S. PATENT DOCUMENTS 1,651,485 A * 12/1927 Thesen ..... A47G 19/2205 222/572
2,069,089 A * 1/1937 Goldman ..... A47G 19/2266 D7/510
5,845,807 A * 12/1998 De Villiers ..... A47G 19/12 222/571
6,705,485 B1 * 3/2004 Sato ..... A47G 19/2272 220/717
2004/0104195 A1 * 6/2004 Yourist ..... B65D 41/0471 215/381
2007/0062961 A1 * 3/2007 Rigas ..... A47G 19/2205 220/703
2008/0083766 A1 * 4/2008 De Rosa ..... A47G 19/2205 220/703
2008/0223882 A1 * 9/2008 Maxwell ..... A47G 19/12 222/465.1
2016/0015199 A1 * 1/2016 Green ..... B65D 47/32 29/428
2016/0073807 A1 * 3/2016 Zeitchick ..... A47G 19/2266 426/2

* cited by examiner

*Primary Examiner* — King M Chu
(74) *Attorney, Agent, or Firm* — Renner, Kenner, Greive, Bobak, Taylor & Weber Co., LPA

(57) ABSTRACT

In various embodiments, the present invention is directed to a drinking glass or cup that eliminated or substantially reduces contact between the user's lower lip and the rim of the glass or cup, thereby preventing or reducing lipstick marks and improving hygiene. In one or more embodiments, the drinking glass or cup of the present invention comprises a recessed or cutout portion sized to allow a lower lip of the user to enter the container when drinking.

14 Claims, 3 Drawing Sheets

DRINKING CONTAINER

CROSS REFERENCE TO RELATED APPLICATIONS

This application claims the benefit of U.S. provisional patent application Ser. No. 63/069,920 entitled "Drinking Container," filed Aug. 25, 2020, and incorporated herein by reference in its entirety.

FIELD OF THE INVENTION

One or more embodiments of the present invention relates to a drinking container. In certain embodiments, the invention relates to a drinking container for avoiding or limiting contact with the lips while drinking.

BACKGROUND OF THE INVENTION

When a person drinks from a conventional drinking container like a cup or a glass, their lower lip will be pressed against the rim of the container. This creates hygiene issues if more than one person drinks from the glass and if the drinker, generally a woman, has applied lipstick or a similar material to their lips, the lipstick often comes off on the rim of the glass and requires special attention to remove. As many, if not most, women wear some sort of lipstick when they go out, this can be a significant problem as women risk leaving an unsightly lipstick ring on any glass, cup or other vessel that they drink from. It is also a problem for bartenders and dishwashers in the bars and restaurants they frequent since these classes and cups will need to hand washed or at least inspected to insure that these lipstick rings are removed. As lipstick has been formulated to stay on the lips longer, it has also become more difficult to remove from cups and glasses. Various systems have been developed to address these issues by placing a protective cover over the rim of the glass (see, e.g., U.S. Pat. No. 553,836 and U.S. Published Application No. 2008/0149650), but these have proven unsatisfactory.

What is needed in the art is a drinking glass or other vessel that is formed in such a way as to prevent lipstick residues from adhering to glasses and other drinking vessels.

SUMMARY OF THE INVENTION

In various embodiments, the present invention provides an improved drinking vessel which limits or prevents contact between the lips of the user and the drinking container to prevent lipstick residues from adhering to glasses and other drinking containers. In the drinking vessels of the present invention, the area of the lip of the drinking vessel that would ordinarily be contacted by the lips has been removed to allow the lower lip to be inserted into the drinking container.

In various embodiments, the present invention is directed to cup, glass or other container for drinking comprising a vessel for holding a liquid to be consumed having an open end forming a rim at which a user may drink, wherein the rim comprises a recessed portion sized to allow a lower lip of the user to enter the container when drinking such that the recessed portion of the rim contacts the user's face below the user's lips such that the user's lips do not contact the cup, glass or other container when the user drinks at the recessed portion. In one or more embodiments, the container is a drinking glass, wine glass, tumbler, cup, or stein. In various embodiments, the recessed portion has a width approximately equivalent to the width of the user's mouth. In some embodiments, the recessed portion has a width of from about 3.6 cm to about 4.8 cm. In some embodiments, the recessed portion has a height approximately equivalent to the thickness of the user's lower lip. In some embodiments, the recessed portion has a height of from about 0.8 cm to about 2.2 cm. In some embodiments, the cup, glass, or other drinking container is a wine glass. In some other embodiments, the cup, glass, or other drinking container is a coffee cup.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF THE ILLUSTRATIVE EMBODIMENTS

Figure 1:
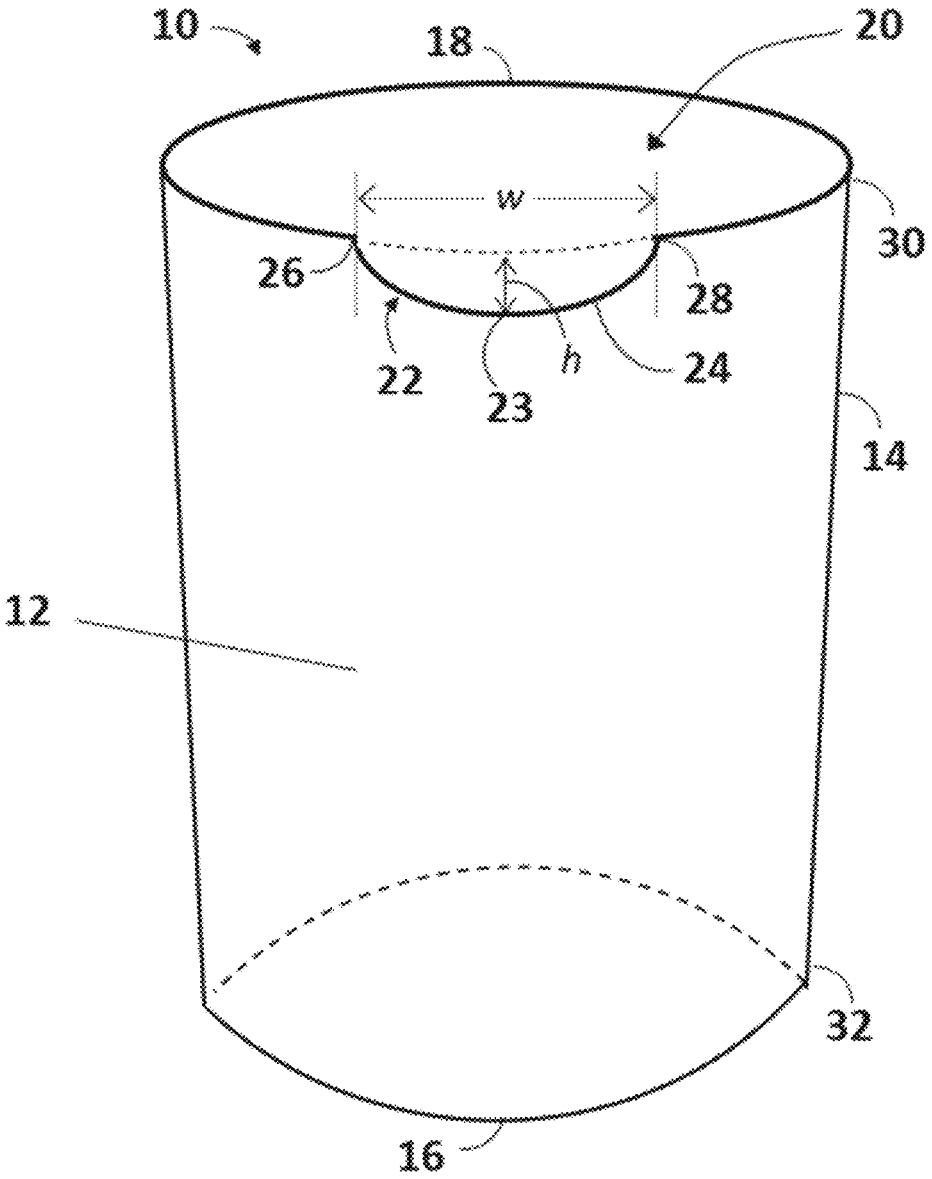
FIG. 1 is a front, top perspective view of a drinking glass according to one or more embodiments of the present invention.

The following is a detailed description of the disclosure provided to aid those skilled in the art in practicing the present disclosure. Those of ordinary skill in the art may make modifications and variations in the embodiments described herein without departing from the spirit or scope of the present disclosure. Unless otherwise defined, all technical and scientific terms used herein have the same meaning as commonly understood by one of ordinary skill in the art to which this disclosure belongs. The terminology used in the description of the disclosure herein is for describing particular embodiments only and is not intended to be limiting of the disclosure.

In various embodiments, the present invention provides an improved drinking vessel which limits or prevents contact between the lips of the user and the drinking container to prevent lipstick residues from adhering to glasses and other drinking containers. In the drinking vessels of the present invention, the area of the lip of the drinking vessel that would ordinarily be contacted by the lips has been removed to allow the lower lip to be inserted into the drinking container. In various embodiments, this cut-out area will have a width that is approximately equal to the width of a human mouth and a height approximately equal to the thickness of a human lower lip at its thickest point.

The following terms may have meanings ascribed to them below, unless specified otherwise. As used herein, the terms "comprising" "to comprise" and the like do not exclude the presence of further elements or steps in addition to those listed in a claim. Similarly, the terms "a," "an" or "the" before an element or feature does not exclude the presence of a plurality of these elements or features, unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein in the specification and the claim can be modified by the term "about."

It should be also understood that the ranges provided herein are a shorthand for all the values within the range and, further, that the individual range values presented herein can be combined to form additional non-disclosed ranges. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50.

Further, as used herein, the terms "drinking vessel," "vessel for drinking" "drinking container," and "container for drinking" are used interchangeably to refer to any vessel or container capable of holding a fluid and having an opening defined by a rim at which the user may drink. Suitable examples would include, without limitation, cups, tea cups, coffee cups, drinking glasses, tumblers, water glasses, ice tea glasses, stemware, wine glasses (all types), water goblets, flutes, snifters, cordials, martini glasses, daiquiri glasses, margarita glasses, hurricane glasses, Irish coffee glasses, hi-ball glasses, rocks glasses, Collins glasses, Old Fashion glasses, shot glasses, beer mugs, beer steins, pint glasses, pilsner glasses, Weizen glasses, and other similar drinking glasses or cups. In various embodiments, the drinking vessels of the present invention can be made of any material capable of holding the fluid to be consumed long enough to be consumed. In various embodiments, the drinking vessels of the present invention may comprise glass, colored glass, crystal, crystallin, tempered glass, annealed glass, metal, stainless steel, tin, porcelain, ceramics, Styrofoam, plastic, polycarbonate, styrene acrylonitrile resin (SAN), coated cardboard, wax coated paper, wood, or combinations thereof.

All publications, patent applications, patents, and other references mentioned herein are expressly incorporated by reference in their entirety, which means that they should be read and considered by the reader as part of this text. That the document, reference, patent application, or patent cited in this text is not repeated in this text is merely for reasons of conciseness. In the case of conflict, the present disclosure, including definitions, will control. All technical and scientific terms used herein have the same meaning.

Further, any compositions or methods provided herein can be combined with one or more of any of the other compositions and methods provided herein. The fact that given features, elements or components are cited in different dependent claims does not exclude that at least some of these features, elements or components maybe used in combination together.

Referring now to FIG. 1, an improved drinking vessel is shown, generally indicated by the numeral 10. Drinking vessel 10 includes a reservoir 12 for holding the fluid to be consumed having one or more sides 14, a bottom 16, and a rim 18, which defines a top opening 20. As set forth above, drinking vessel 10 can be essentially any type of conventional drinking glass, cup or stein that has a holds a fluid and has a rim at which the user drinks the fluid contained therein. Accordingly, reservoir 12 can be of substantially any shape having a defined internal volume that can hold a volume of a fluid and has a top opening 20 and rim 18 where the user drinks. In most embodiments, reservoir 12 will be substantially round in horizontal cross section, but this need not be the case. In various embodiments, reservoir 12 may have horizontal cross-sectional area that is oval, polygonal, or irregular and may or may not be symmetrical about a vertical axis. As will be apparent, the number and shape of the one or more sides 14 will vary depending on the overall shape of reservoir 12. The one or more sides 14 will each have a top edge 30 which meets top opening 20 and collectively will form rim 18 around the perimeter of the top opening 20. The embodiments shown in FIG. 1 is a tumbler and in these embodiments, sides 14 will also have a lower edge 32 which meets with and is joined with a bottom 16. As will be understood, sides 14 and bottom 16 may be formed as one piece of may be joined by any conventional method as is known in the art. In the tumbler shown in FIG. 1, bottom 16 is a single flat surface to provide stability, but other embodiments are possible. (See, e.g., FIG. 2, below).

In most drinking vessels, the rim is generally uniform so that the user may drink at any point on the rim with equal facility. As set forth above, however, in this arrangement the lower lip of the user is pressed against the rim of the drinking vessel, which can cause unsightly lipstick marks on the glass that are difficult to efficiently remove. Accordingly, the drinking vessels 10 of the present invention have a cut-out or recessed area 22 defining a lower front rim 24 running from a first end 26 to a second end 28. As can be seen in FIG. 1, the distance from the first end 26 to the second end 28 define a cutout width w and the distance from the lowest point 23 of the front rim 24 to the level of the adjacent segments of rim 18 define a cutout height h. Lowest point 23 is preferably located at the midpoint on lower rim 24 between first and second ends 26 and 28.

Figure 2:
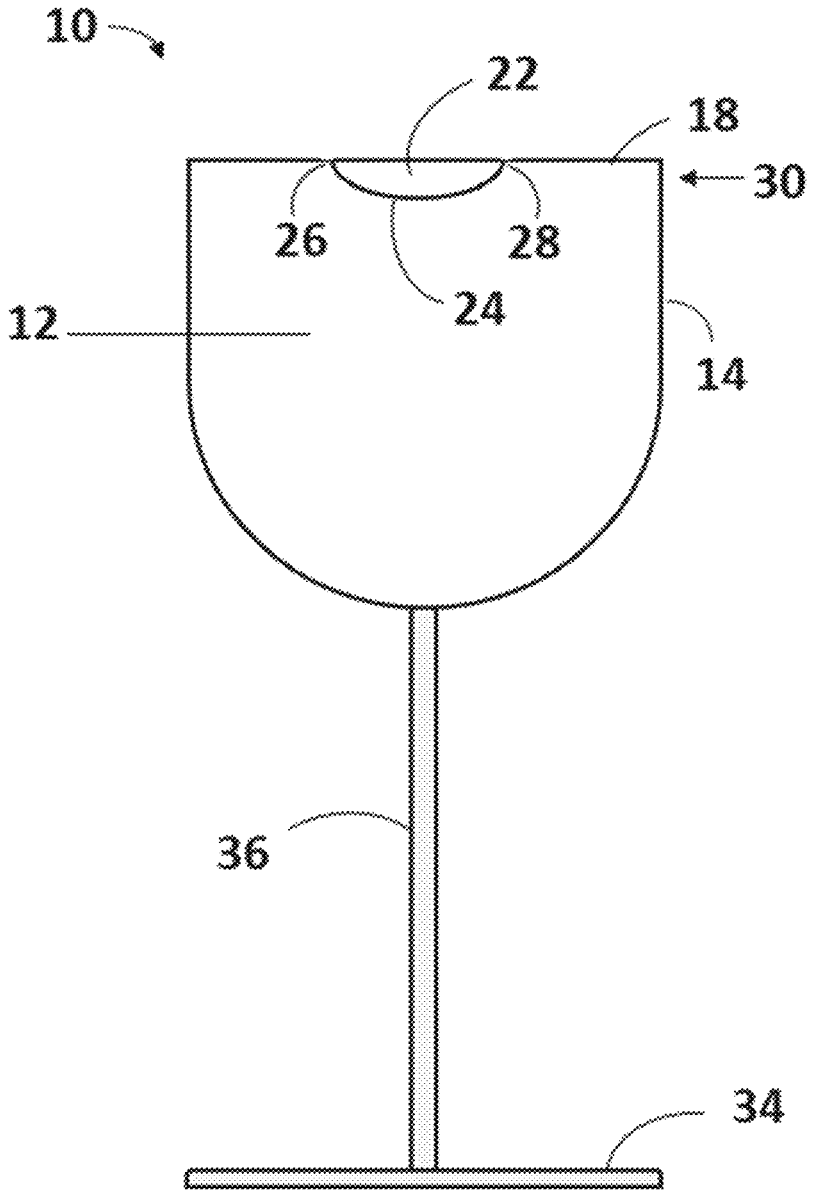
FIG. 2 is a front elevational view of a drinking glass for wine according to one or more embodiments of the present invention.

As set forth above, the present invention may be used with any drinking vessel having a rim at which the user drinks. FIG. 2, for example, shows an embodiment where the drinking vessel 10 is a wine glass or goblet. In these embodiments, drinking vessel 10 will comprise a reservoir 12 for holding the fluid to be consumed, as set forth above, a base 34, and a stem 36, running between a top surface of base 34 and the bottom of reservoir 12, as shown. In these embodiments, the sides 14 form a rounded bottom of reservoir 12 and therefore, lack a bottom edge 32, and a bottom 16. As can be seen, the embodiment shown in FIG. 2 further comprises a cutout or recessed area 22 defining a lower front rim 24 running from a first end 26 to a second end 28, substantially as shown and described with respect to FIG. 1.

In various embodiments, the cutout width w will be approximately the same as the width of a user's mouth, as measured from corner to corner with the mouth closed. The width of the human mouth is generally known in the art but can vary with the age, height, gender, and ethnic background of the user. See, e.g., Abrishami, M., Shahri, N. M., Zadeh, J. K., "Photographic Study of Lip Anthropometric Pattern Development in the Fars Family in Mashhad" *Anatomical Sciences* November 2014, Volume 11, Number 4. pp. 175-182; Re, D. E., Rule, N. O., "The big man has a big mouth: Mouth width correlates with perceived leadership ability and actual leadership performance" *Journal of Experimental Social Psychology* 63 (2016) 86-93; Samal, A., Bubramani, V., Marx, D. B., "An Analysis of Sexual Dimorphism in the Human Face" *Journal of Visual Communication and Image Representation* 18 (2007), pp. 453-463; doi:10.1016/j.jvcir.2007.04.010, Ese Anibor, Dennis E. O. Eboh and Mabel O. Etetafia, "A study of craniofacial parameters and total body height" *Advances in Applied Science Research,* 2011, 2 (6):400-405, the disclosure of which are incorporated herein by reference in their entirety. If cutout width w is substantially smaller than the width of the user's mouth, the lower lip will not be able to fully enter the reservoir and will contact the rim adjacent to the cutout section. On the other hand, if the cutout width w is substantially larger than the width of the user's mouth, fluid may leak around the cutout section and spill onto the user. One of ordinary skill in the art will be able determine a suitable cutout width w without undue experimentation.

In various embodiments, w will be from about 3.2 cm to about 5.7 cm. In some embodiments w will be from about 3.6 cm to 4.8 cm, in other embodiments, from about 4.0 cm to about 4.6 cm, in other embodiments, from about 4.2 cm to about 4.6 cm, in other embodiments, from about 4.4 cm to about 4.6 cm, in other embodiments, from about 3.6 cm to about 4.4 cm, in other embodiments, from about 3.6 cm to about 4.2 cm, in other embodiments, from about 3.6 cm to about 4.2 cm, in other embodiments, from about 3.6 cm to about 4.0 cm, and in other embodiments, from about 3.6 cm to about 3.8 cm. Here, as well as elsewhere in the specification and claims, individual range values can be combined to form additional non-disclosed ranges. Preferably, ends 26, 28 of the lower rim will line up with the corners of the user's mouth when drinking.

Figure 3:
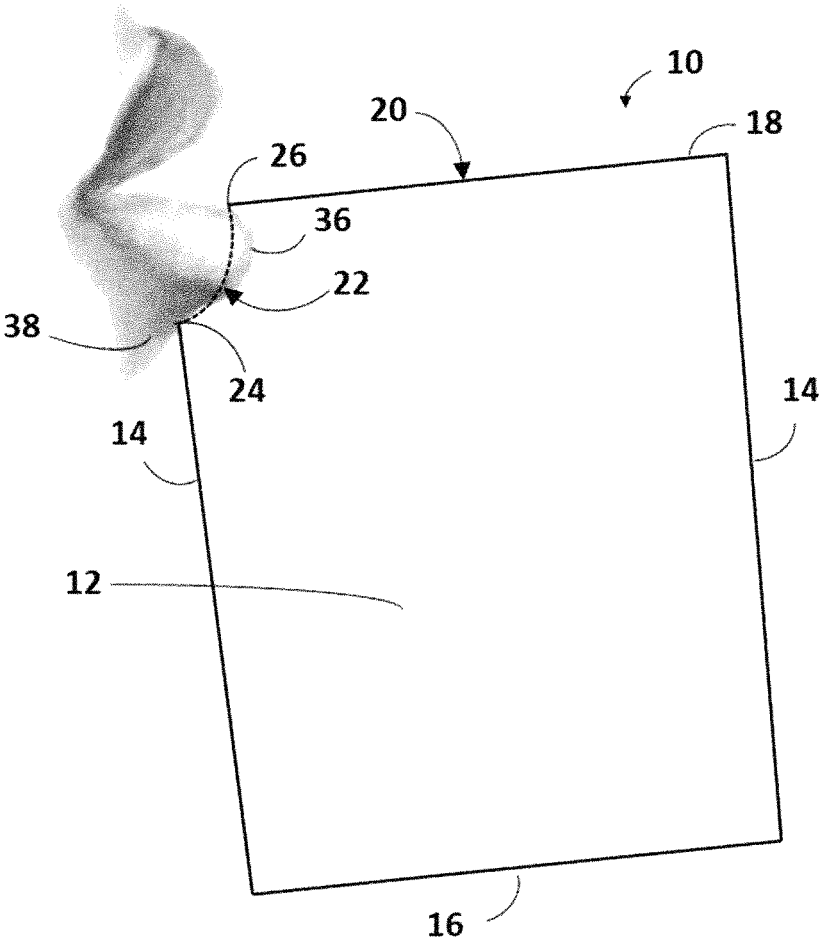
FIG. 3 is a is a cross sectional view of a drinking according to one or more embodiments of the present invention showing interface with the users lips.

The cutout height h should be large enough to allow the entire lower lip of the user to enter the drinking vessel, so that the lower lip need not touch the rim of the glass to drink and the corners of the user's mouth are aligned vertically with the ends 26, 28 of the lower rim. In various embodiments, cutout height may be from about 0.8 cm to about 2.2 cm, in other embodiments, from about 1.0 cm to about 2.0 cm, in other embodiments, from about 1.25 cm to about 2.0 cm, in other embodiments, from about 1.5 cm to about 2.0 cm, in other embodiments, from about 1.75 cm to about 2.0 cm, in other embodiments, from about 0.8 cm to about 2.0 cm, in other embodiments, from about 0.8 cm to about 1.75 cm, in other embodiments, from about 0.8 cm to about 1.5 cm, and in other embodiments, about 0.8 cm to about 1.25 cm. In some embodiments, cutout height may be about 1.0 cm. During drinking, the lower rim 24 of the drinking vessel 10 is pressed against the user's face 38 just below the lower lip 36 to form a seal and the user drinks with their lower lip in the drinking vessel 10. (See FIG. 3) Here, as well as elsewhere in the specification and claims, individual range values can be combined to form additional non-disclosed ranges.

As will be apparent, lower rim 24 will have a generally curved shaped comparable to the curved shape of the bottom of a human lower lip 36 where it meets the face 38. (See FIG. 3) In various embodiments, lower rim 24 will curve from lowest point 23 to first and second ends 26 and 28 and is preferably symmetrically with respect to lowest point 23. As set forth above, lowest point 23 is preferably located at the midpoint of lower rim 24 between first and second ends 26 and 28.

The drinking vessel of the present invention may be constructed in any conventional manner using any conventional materials as set forth above. In some embodiments, drinking vessel of the present invention may be constructed from a conventional drinking vessel by removing material at the rim where the user drinks to form the cutout area described above. In these embodiments, care must be taken to ensure that the newly formed lower rim does not have any sharp or rough places that could cut or otherwise injure the user. In some other embodiments, the cutout region can be formed into the drinking vessel during its construction using any conventional means.

In view of the foregoing, it should be appreciated that the present invention significantly advances the art by providing a drinking vessel that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A container for drinking comprising a vessel for holding a liquid to be consumed having an open end forming a rim at which a user may drink and one or more sides, wherein said rim comprises a recessed portion sized to allow a lower lip of the user to enter the container when drinking and the recessed portion of said rim contacts the user's face below the user's lips, wherein said recessed portion is substantially aligned with a side and does not extend outward toward or into the mouth when drinking such that the user's lips do not contact said container when the user drinks at said recessed portion; and wherein said recessed portion has a width of from about 3.6 cm to about 4.8 cm and a height of from about 0.8 cm to about 2.2 cm.

2. The container for drinking of claim 1 wherein said container is a drinking glass, wine glass, tumbler, cup, or stein.

3. The container for drinking of claim 1 wherein said recessed portion has a width approximately equivalent to the width of the user's mouth.

4. The container for drinking of claim 1 wherein said recessed portion has a height approximately equivalent to the thickness of the user's lower lip.

5. A method of drinking using the container for drinking of claim 1 comprising:

A) preparing or acquiring a container for drinking according to claim 1, said container for drinking comprising a vessel for holding a liquid to be consumed and having and one or more sides and an open end forming a rim at which a user may drink, wherein said rim comprises a recessed portion sized to allow a lower lip of the user to enter the container when drinking, said recessed portion being substantially aligned with a side and not extending outward toward or entering the mouth, instead contacting the face below the mouth;

B) filling said vessel with a quantity of a fluid to be consumed by a human user;

C) orienting the container for drinking so that the recessed portion of said rim is facing the mouth of the human user;

D) placing the lip of the user into the recessed portion of said lip of the container such that the lower lip does not contact said container and the rim is pressed against an area of the user's face below said lower lip; and E) tipping the container to allow the liquid to enter the mouth for drinking.

6. The method of claim 5 wherein said container for drinking is a drinking glass, wine glass, tumbler, cup, or stein.

7. The method of claim 5 wherein said recessed portion has a width of from about 3.6 cm to about 4.8 cm.

8. The method of claim 5 wherein said recessed portion has a height of from about 0.8 cm to about 2.2 cm.

9. A cup or glass for drinking having a rim at which a user may drink and one or more sides, wherein said rim comprises a recessed portion sized to allow a lower lip of the user to enter the container when drinking and the recessed portion of said rim is substantially aligned with a side and does not extend outward or enter the mouth when drinking and contacts the user's face below the user's lips such that the user's lips do not contact said cup or glass when the user drinks at said recessed portion.

10. The cup or glass for drinking of claim 9, said cup or glass is a drinking glass, wine glass, tumbler, cup, or stein.

11. The cup or glass for drinking of claim 9, wherein said recessed portion has a width approximately equivalent to the width of the user's mouth.

12. The cup or glass for drinking of claim 9, wherein said recessed portion has a height approximately equivalent to the thickness of the user's lower lip.

13. The cup or glass for drinking of claim 9, wherein said cup or glass is a wine glass.

14. The cup or glass for drinking of claim 9, wherein said cup or glass is a coffee cup.

* * * * *